US010773265B2

(12) United States Patent
Seiz et al.

(10) Patent No.: US 10,773,265 B2
(45) Date of Patent: Sep. 15, 2020

(54) BELL CUP OR ATOMIZER RING COMPRISING AN INSULATING COATING

(71) Applicant: Dürr Systems AG, Bietigheim-Bissingen (DE)

(72) Inventors: Bernhard Seiz, Lauffen (DE); Michael Baumann, Flein (DE); Hans-Jürgen Nolte, Besigheim (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 190 days.

(21) Appl. No.: 15/545,034

(22) PCT Filed: Jan. 13, 2016

(86) PCT No.: PCT/EP2016/000054
§ 371 (c)(1),
(2) Date: Jul. 20, 2017

(87) PCT Pub. No.: WO2016/116261
PCT Pub. Date: Jul. 28, 2016

(65) Prior Publication Data

US 2018/0280999 A1 Oct. 4, 2018

(30) Foreign Application Priority Data

Jan. 21, 2015 (DE) ..... 10 2015 000 709

(51) Int. Cl.
*B05B 5/04* (2006.01)
*B05B 15/14* (2018.01)

(52) U.S. Cl.
CPC ..... *B05B 5/0407* (2013.01); *B05B 5/0403* (2013.01); *B05B 5/0426* (2013.01); *B05B 15/14* (2018.02)

(58) Field of Classification Search
CPC ..... B05B 5/0407; B05B 15/14; B05B 5/0403; B05B 5/0426
(Continued)

(56) References Cited

U.S. PATENT DOCUMENTS 4,422,577 A 12/1983 Arnold et al.
5,167,218 A * 12/1992 Deakin ..... C23C 4/123 126/569
(Continued)

FOREIGN PATENT DOCUMENTS

CN 102056674 A 5/2011
CN 102427888 A 4/2012
(Continued)

OTHER PUBLICATIONS

Chinese Office Action for Application No. 201680006849.7 dated Jan. 29, 2019 (11 pages).
(Continued)

*Primary Examiner* — Tuongminh N Pham
(74) *Attorney, Agent, or Firm* — Bejin Bieneman PLC

(57) ABSTRACT

The present disclosure provides a coating plant components and an assembly of such components for a rotary atomizer. The components may be a bell cup and/or an atomizer ring. The component includes a metal main part and a non-metal material at least partially covering or coating the main part. The coating or insert of non-metal material is positioned to provide a barrier to inhibit metal-on-metal contact between, e.g., a bell cup and an atomizer ring. The present disclosure further provides a method for applying non-metal material to a coating plant component.

13 Claims, 6 Drawing Sheets

Figure 1:
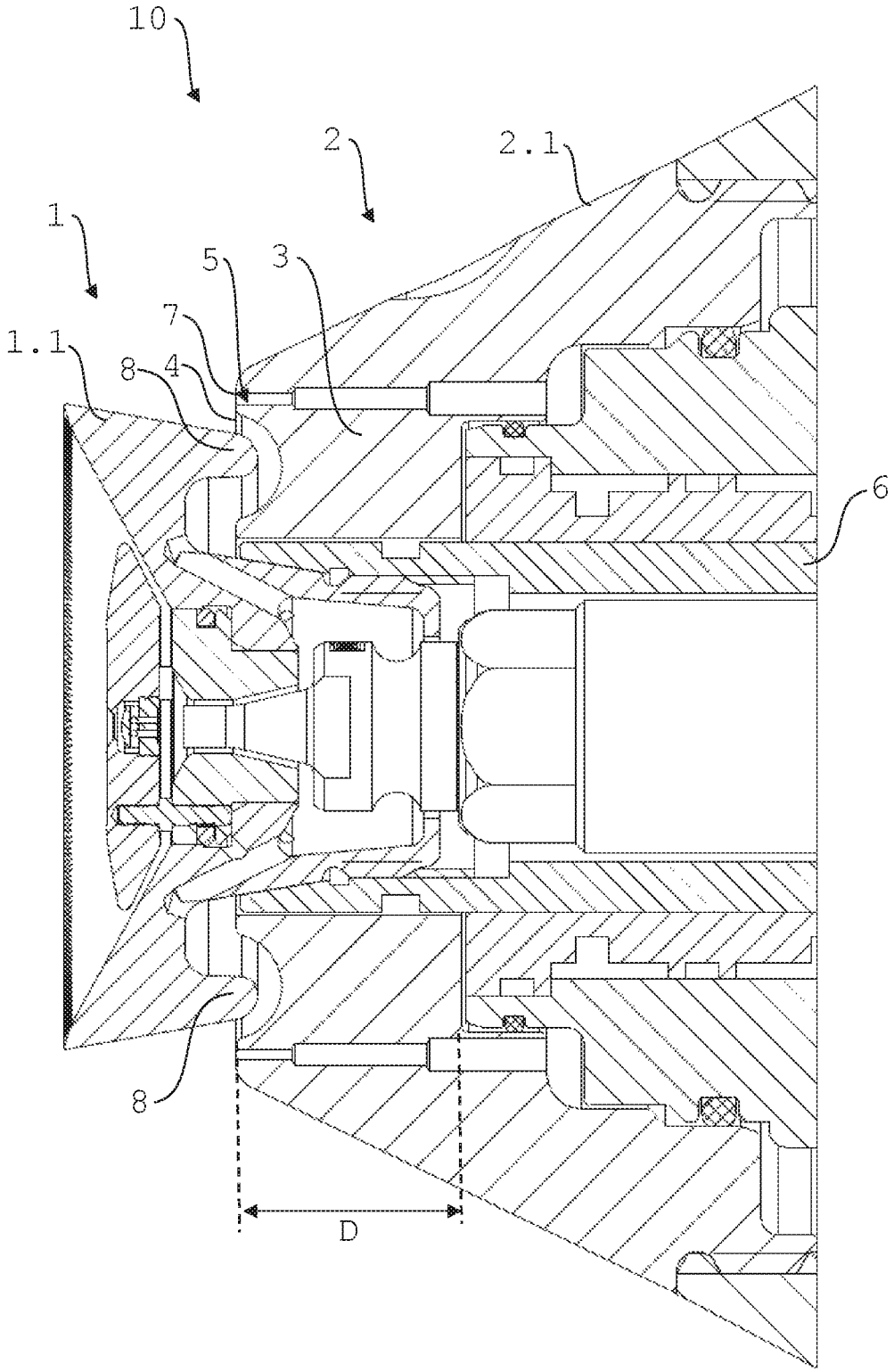

(58) Field of Classification Search
USPC ..... 239/690–728, 223, 225–265
See application file for complete search history.

(56) References Cited

U.S. PATENT DOCUMENTS

| | | | | |
|---|---|---|---|---|
| 5,632,448 | A | 5/1997 | Alexander et al. | |
| 5,775,598 | A * | 7/1998 | Takayama | B05B 5/0533 239/703 |
| 8,881,672 | B2 | 11/2014 | Fischer et al. | |
| 2002/0066809 | A1* | 6/2002 | Borner | B05B 5/0533 239/703 |
| 2010/0211205 | A1 | 8/2010 | Baumann et al. | |
| 2011/0086166 | A1* | 4/2011 | Fischer | B05B 5/0407 427/248.1 |
| 2012/0006916 | A1 | 1/2012 | Nolte et al. | |
| 2013/0153681 | A1 | 6/2013 | Mitsui et al. | |
| 2015/0258554 | A1* | 9/2015 | Steur | B05B 3/1014 239/223 |

FOREIGN PATENT DOCUMENTS

| | | | |
|---|---|---|---|
| CN | 202578829 | U | 12/2012 |
| CN | 103068491 | A | 4/2013 |
| CN | 202955013 | U | 5/2013 |
| CN | 203671053 | U | 6/2014 |
| DE | 3129151 | A1 | 3/1982 |
| DE | 102008027997 | A1 | 12/2009 |
| DE | 102009013979 | A1 | 9/2010 |
| EP | 0767005 | A1 | 4/1997 |
| EP | 1038588 | A1 | 9/2000 |
| EP | 2213378 | A1 | 8/2010 |
| EP | 2610011 | A1 | 7/2013 |
| JP | H08332418 | A | 12/1996 |
| JP | 2001113207 | A | 4/2001 |
| JP | 2002538957 | A | 11/2002 |
| JP | 2005288284 | A | 10/2005 |
| JP | 2011524801 | A | 9/2011 |
| JP | 2012045467 | A | 3/2012 |
| KR | 1020110050614 | A | 5/2011 |
| KR | 1020130100109 | A | 9/2013 |
| WO | 2000031286 | A1 | 6/2000 |
| WO | 2000054888 | A1 | 9/2000 |
| WO | 2009149950 | A1 | 12/2009 |
| WO | 2010105849 | A1 | 9/2010 |
| WO | 2012026350 | A1 | 3/2012 |

OTHER PUBLICATIONS

International Search Report and Written Opinion for PCT/EP2016/000054 dated Apr. 4, 2016 (10 pages; with English translation).
Japanese Patent Office Notification of Reasons for Rejection for Application No. 2017-538621 dated Oct. 29, 2019 (with English translation of References Cited; 16 pages).

* cited by examiner

BELL CUP OR ATOMIZER RING COMPRISING AN INSULATING COATING

CROSS-REFERENCE TO RELATED APPLICATIONS

This application is a national stage of, and claims priority to, Patent Cooperation Treaty Application No. PCT/EP2016/000054, filed on Jan. 13, 2016, which application claims priority to German Application No. DE 10 2015 000 709.2, filed on Jan. 21, 2015, which applications are hereby incorporated herein by reference in their entireties.

The present disclosure relates to a coating plant component for a rotary atomiser, wherein the coating plant component is provided with a non-metallic material for avoiding sparks. The coating plant component can be a bell cup. The coating plant component can be a directing-air ring.

For the general state of the art, reference may first be made to DE 10 2009 013 979 A1, DE 10 2008 027 997 A1 and US 2010/0 211 205 A1.

Rotary atomisers for painting motor vehicle bodies and add-on parts therefor are known in the prior art in a wide variety of different forms. Such rotary atomisers conventionally comprise a metallic bell cup, which rotates during operation, for atomising the paint and for delivering a jet of paint spray, and a metallic directing-air ring, which does not rotate during operation, for delivering a directing-air stream for shaping the jet of paint spray. There are also directing-air rings made of plastics material. These are used, for example, in the case of external charging (conductive paints). The disadvantage of directing-air rings made of plastics material is that the service life in hard painting operation is shorter. The directing-air rings very quickly become damaged when the directing-air ring is cleaned or even when blocked directing-air bores are "cleaned". For this reason, directing-air rings are produced, where possible (solvent-borne paint, direct charging, water-borne paint or in painting without high voltage), from hard and light materials. The directing-air ring, which is under pressure during operation, is arranged behind the bell cup.

Normally, no contact occurs between the rotating bell cup and the directing-air ring during operation. However, there is the risk in practice, in particular for forms in which the bell cup and the directing-air ring are at only a very small distance from one another, that metallic parts of the bell cup and of the directing-air ring will come into contact with one another. This can occur in particular if the directing-air ring has not been mounted correctly and becomes detached or loosens during operation. This can lead to metal-on-metal contact between the rotating bell cup and the directing-air ring and consequently to sparking and flying sparks. In solvent zones in particular, the sparks can lead to the fire protection system being triggered. A further scenario is that the atomiser spraying sparks enters a cleaning device, where it is sprayed from outside with flammable paint or flushing agent. The risk of a fire is particularly great in this case.

SUMMARY

The present disclosure provides a coating plant component for a rotary atomiser, e.g. an electrostatic rotary atomiser.

The coating plant component may be, in some implementations, a bell cup.

The bell cup is, in some implementations, designed to be arranged in front of a directing-air ring in the operating state and/or to overlap a directing-air ring axially in the operating state. Alternatively or in addition, the bell cup serves in particular for atomising a coating agent and for delivering a spray jet of coating agent (e.g. spray mist). The coating agent is, in some implementations, a lacquer.

The coating plant component may be, in some implementations, an atomizer ring, i.e. a directing-air ring.

The directing-air ring is, in some implementations, designed to be arranged behind a bell cup in the operating state and/or to overlap a bell cup axially in the operating state. Alternatively or in addition, the directing-air ring comprises in particular at least one outlet opening for delivering a directing-air stream for shaping the spray jet of coating agent.

The coating plant component—e.g., in the form of either a bell cup or an atomizer ring—comprises a metallic base body and is distinguished in particular in that the metallic base body is provided with a non-metallic material on its outer side. The non-metallic material is, in some implementations, applied to the coating plant component itself.

The non-metallic material is designed and arranged to avoid and as a barrier to inhibit in particular spark-generating metal-on-metal contact between the bell cup and the directing-air ring, e.g., if the directing-air ring unintentionally becomes detached or loosens during operation and comes into contact with the rotating bell cup.

Because the bell cup rotates during operation, In some implementations, the non-metallic material may be removed at least slightly, but, according to the principles of the present disclosure, an insert of non-metallic material may be sufficiently thick such that is not removed down to the metallic base body, so that metal-on-metal contact and/or sparking can be prevented while accommodating wear and/or damage. At the same time, the damage or removal provides a visual indication as to whether contact has occurred or not. The non-metallic material is compatible with lacquer, also in the case of abrasion, in particular PWIS-free (free of paint-wetting impairment substances).

The thickness of the non-metallic material is thus, in some implementations, sufficient that it cannot be removed down to the metallic base body if the directing-air ring unintentionally becomes detached or loosens during operation and comes into contact with the rotating bell cup.

Within the scope of the present disclosure, metal-on-non-metal contact or non-metal-on-non-metal contact can occur—e.g., both of a bell cup and an atomizer ring include a non-metallic coating or insert.

The non-metallic material may be, in some implementations, a plastics material.

The non-metallic material can be formed on the base body in the form of a non-metallic, relatively thin coating. The coating can have, for example, a thickness of greater than 0.1 mm and/or less than 1.5 mm.

The non-metallic material can likewise be formed on the base body in the form of a non-metallic, relatively thick insert or cover/put-on part. The insert or cover/put-on part can have, for example, a thickness of greater than 0.5 mm and/or less than 10 mm. The insert can be, for example, a non-metallic filling, while the put-on part can be, for example, a non-metallic cover in the form of a crown or cap.

The non-metallic insert serves, in some implementations, for arrangement in a recess on the front side of the directing-air ring.

The non-metallic put-on part serves, in some implementations, for application, in particular in the form of a cap or crown, to a rear, backwardly protruding portion of the bell cup.

The non-metallic material is, in some implementations, arranged on the coating plant component in an annular circumferential manner, so that metal-on-metal contact between the bell cup and the directing-air ring can be inhibited even when the bell cup is rotating during operation and the directing-air ring unintentionally becomes detached or loosens.

The base body is, in some implementations, made of titanium or stainless steel (e.g. V2A or V4A).

The non-metallic material, in particular plastics material, can be one of: thermoplastic plastics material, organic polymer, polyoxymethylene (POM), polyether ether ketone (PEEK), polyamide (PA), polycarbonate (PC), polybutylene terephthalate (PBT), polymethylpentene (PMP), polytetrafluoroethylene (PTFE) and/or ethylene-chlorotrifluoroethylene copolymer (Halar®/ECTFE).

In some implementations, a layer, for example an electrostatic layer, is formed beneath the non-metallic material, so that the non-metallic material is applied to the layer, for example the electrostatic layer. The layer can further promote adhesion of the non-metallic material to the coating plant component.

The non-metallic material and/or the above-mentioned layer can, in some implementations, serve to prevent the occurrence of different potentials at the different materials on the coating plant component (e.g. on the directing-air ring), so that uncontrolled discharges can be avoided.

The non-metallic material may be electrically conductive and, in some implementations, not dielectric. The dielectric conductivity can be, for example, approximately from 50 to 100 kOhms at a test voltage of from 30 to 70 V.

The non-metallic material can, for example, have a width of less than 50 mm; 40 mm; 30 mm; 20 mm; 15 mm; 10 mm; 7.5 mm; 5 mm; 4 mm; or 3 mm.

In some implementations, the thickness (size) of the non-metallic material is greater than 0.1 mm; 0.2 mm; 0.3 mm; 0.4 mm; 0.5 mm; 0.6 mm; 0.7 mm; 0.8 mm; 1.0 mm; 1.2 mm; or 1.4 mm and thus in particular is sufficient not to be removed down to the metallic base body if it is removed at least slightly during operation by contact with the rotating bell cup.

The thickness of the non-metallic material can be, for example, less than 10 mm; 7.5 mm; 5.0 mm; 4.0 mm; 3.0 mm; 2 mm; 1.5 mm; or 0.5 mm.

In some implementations, the non-metallic material is arranged on or in the front side of the directing-air ring.

The front side of the directing-air ring corresponds to the side which, in the operating state and/or in the mounted state, faces the bell cup.

The directing-air ring is provided with a recess and the recess, in some implementations, serves to receive a rear, backwardly protruding portion of the bell cup and/or to receive the non-metallic material.

The backwardly protruding portion of the bell cup can in particular be received in the recess in such a manner that it projects axially into the recess and/or in such a manner that the bell cup and the directing-air ring overlap axially.

Within the scope of the present disclosure, the recess can thus, in some implementations, serve to receive a rear, backwardly protruding portion of the bell cup and/or to receive the non-metallic material.

Within the scope of the present disclosure, the recess can have, for example, two receiving regions, namely a rear region for the non-metallic material and a front region for the rear, backwardly protruding portion of the bell cup.

In other implementations, it is possible for the recess to have, for example, only one receiving region which can serve to receive together the non-metallic material and the rear, backwardly protruding portion of the bell cup.

The recess is, in some implementations, arranged in the front side of the directing-air ring in an annular circumferential manner.

The recess is, in some implementations, arranged coaxially with the directing-air ring and/or with the bell cup.

The outlet openings of the directing-air ring for delivering a directing-air stream are, in some implementations, arranged radially outside the non-metallic material, that is to say in particular are arranged over a larger diameter than the non-metallic material.

The non-metallic material can, in some implementations, be arranged on or in the rear side of the bell cup, for example on a rear, backwardly protruding, convex portion of the bell cup.

The rear side of the bell cup corresponds to the side that faces the directing-air ring in the operating state and/or in the mounted state.

The rear, backwardly protruding portion of the bell cup can be arranged, for example, in an annular circumferential manner and/or can serve to be received in the recess on the front of the directing-air ring.

In some implementations, the non-metallic material of the directing-air ring is concave in shape on the side facing the bell cup or extends in a conically widening manner on the side facing the bell cup.

In some implementations, the non-metallic material of the bell cup is convex in shape on the side facing the directing-air ring or extends in a conically tapering manner on the side facing the bell cup.

It should be understood that the feature "air" within the scope of the present disclosure may also include other gaseous media.

In some implementations, the directing-air ring can be a separate component, fixed to a rotary atomiser. In other implementations, the directing-air ring is an integral part of the rotary atomiser and/or of the rotary atomiser housing.

The bell cup is arranged in front of the directing-air ring in the operating state.

In some implementations, the directing-air ring and the bell cup overlap axially in the mounted state and/or in the operating state, e.g. between the above-mentioned recess in the front of the directing-air ring and the above-mentioned rear, backwardly protruding portion of the bell cup. In such an operating state and/or mounted state, a portion of the bell cup is consequently housed in the directing-air ring.

In some implementations, both the bell cup and the directing-air ring can be provided with a non-metallic material, so that there is non-metal-on-non-metal contact if the directing-air ring unintentionally becomes detached or loosens during operation.

In some implementations, the non-metallic material can be applied to substantially the entirety of the rear outer casing of the bell cup, in order to improve the cleaning capability of the rear edge or of the rear outer casing of the bell cup. The non-metallic material can be applied, for example, to substantially all the outer surfaces of the bell cup, with the exception of the front surface of the bell cup over which the paint flows.

The non-metallic material can, in some implementations, be applied to the metallic base body without an adhesive.

The non-metallic material is lacquer- and/or solvent-resistant and, alternatively or in addition, PWIS-free.

The base body of the bell cup and/or the base body of the directing-air ring is, in some implementations, made of a metal, for example of titanium or stainless steel, for reasons of stability or strength.

it should be understood that, in a conventional rotary atomizer, the bell cup rotates during operation and/or the directing-air ring does not rotate during operation.

The coating plant component is, in some implementations, a painting plant component for a painting plant for painting motor vehicle bodies and/or add-on parts thereof.

The present disclosure is used in particular in the case of relatively compact, axially short bell cup/directing-air ring arrangements, in which the bell cup and the directing-air ring overlap axially in the operating state. Use in so-called free-standing bell cups is likewise possible.

The present disclosure also includes a, in some implementations, electrostatic rotary atomiser for painting motor vehicle bodies and/or add-on parts thereof. The rotary atomiser comprises a bell cup and/or a directing-air ring as disclosed herein.

The present disclosure additionally includes a method for providing a coating plant component for a rotary atomiser with a non-metallic material.

The coating plant component is a bell cup or a directing-air ring and comprises a metallic base body.

The method is distinguished in particular in that the metallic base body is provided with a non-metallic material.

The coating plant component has been or is configured as disclosed herein.

In some implementations, the coating plant component is provided with an electrostatic layer, and the non-metallic material is applied to the electrostatic layer.

The non-metallic material and/or the electrostatic layer can be applied to the metallic base body with a powder coating, thermal spraying or polymer coating.

In some implementations, before the non-metallic material and/or the electrostatic layer are applied to the coating plant component, the coating plant component is subjected to a burning process and/or a sandblasting process. The burning process serves in particular to render the coating plant component free of grease and/or residues. Sandblasting, for example with an aluminium oxide, serves in particular to improve the adhesion to the base material (titanium/stainless steel).

The non-metallic material, in particular the non-metallic coating, is, in some implementations, applied to the metallic base body, in particular to the electrostatic layer, without an adhesive.

A deceleration process of the bell cup occurs when there is contact between the metal and the non-metallic material, in particular the plastics material. This reduces the risk of sparking and consequently, for example, of a fire and can lead to "fusion" and/or bonding of the components. Deceleration and/or fusion and arresting can in any case be diagnosed as a fault by a speed regulator/controller and can lead to rapid stoppage and thus to minimisation of risk by the regulating/control system.

DRAWINGS

Figure 2:
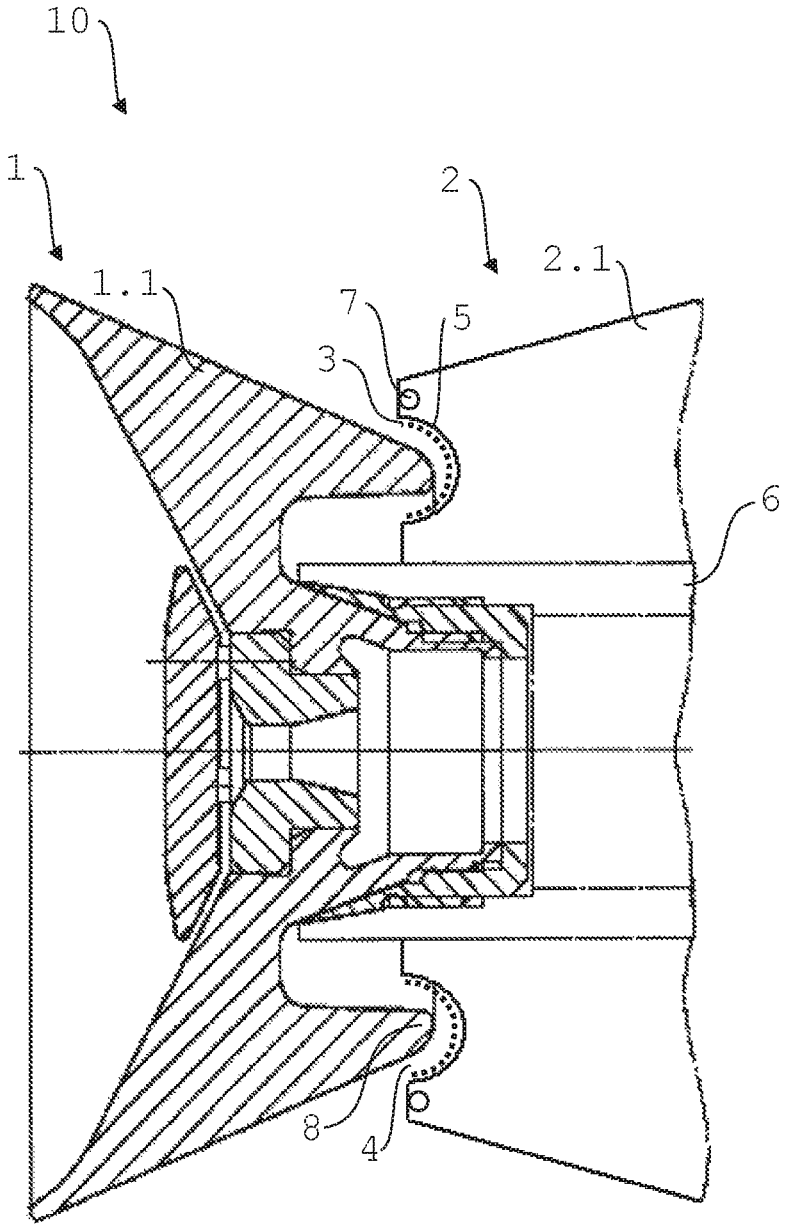
Figure 3:
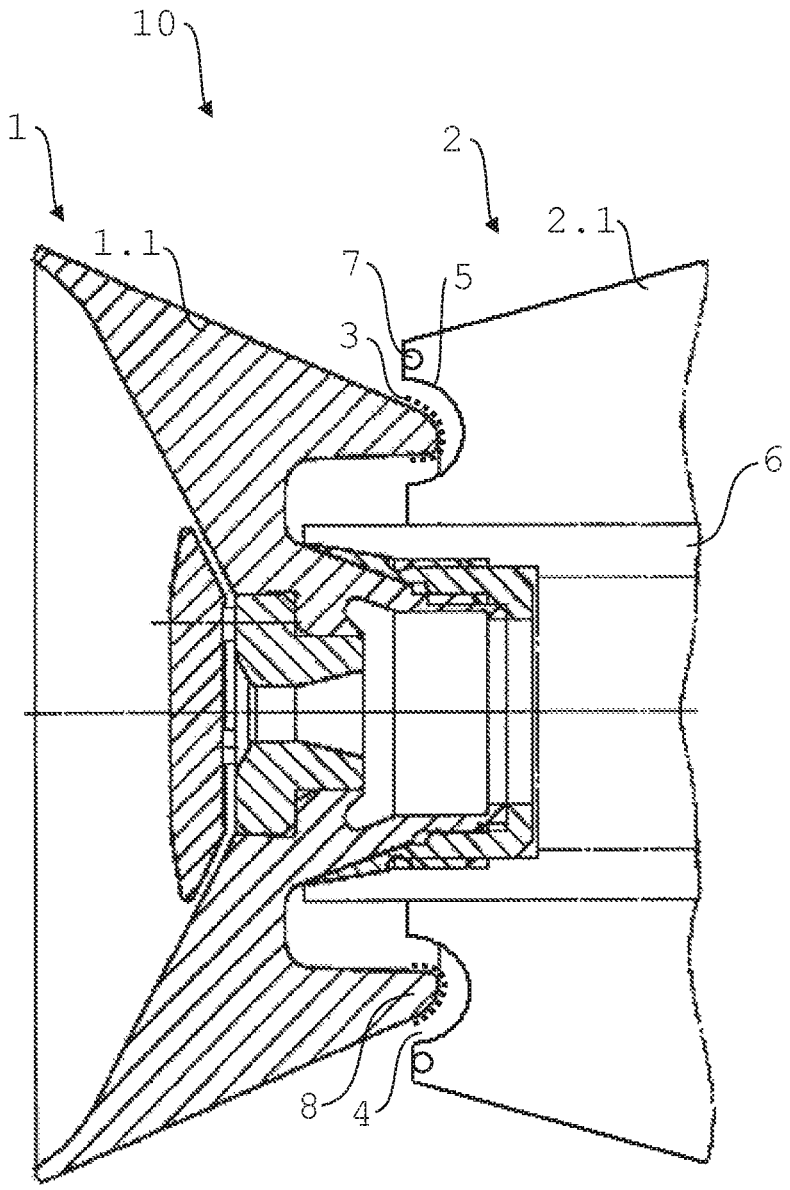
Figure 4:
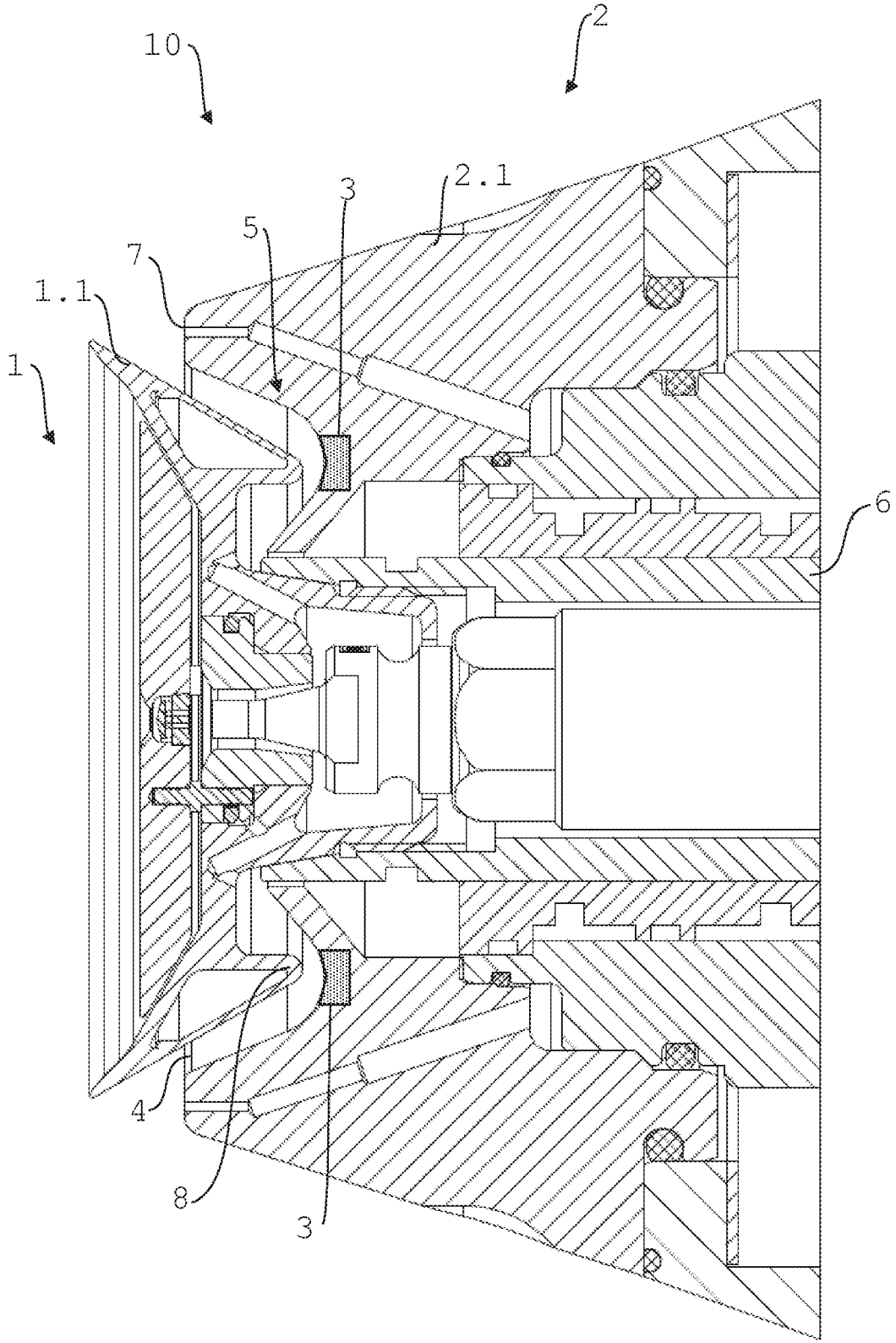
Figure 5:
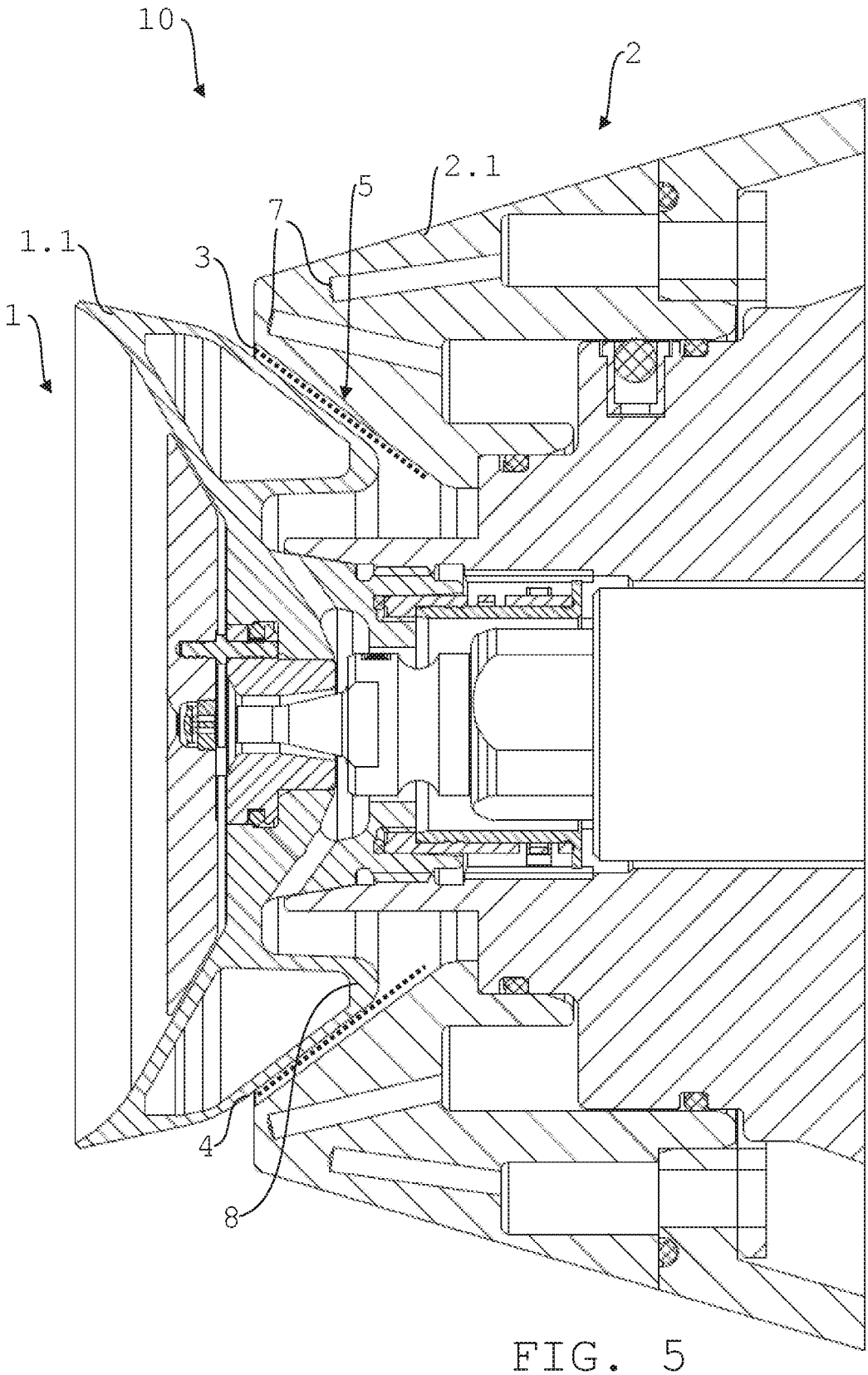
Figure 6:
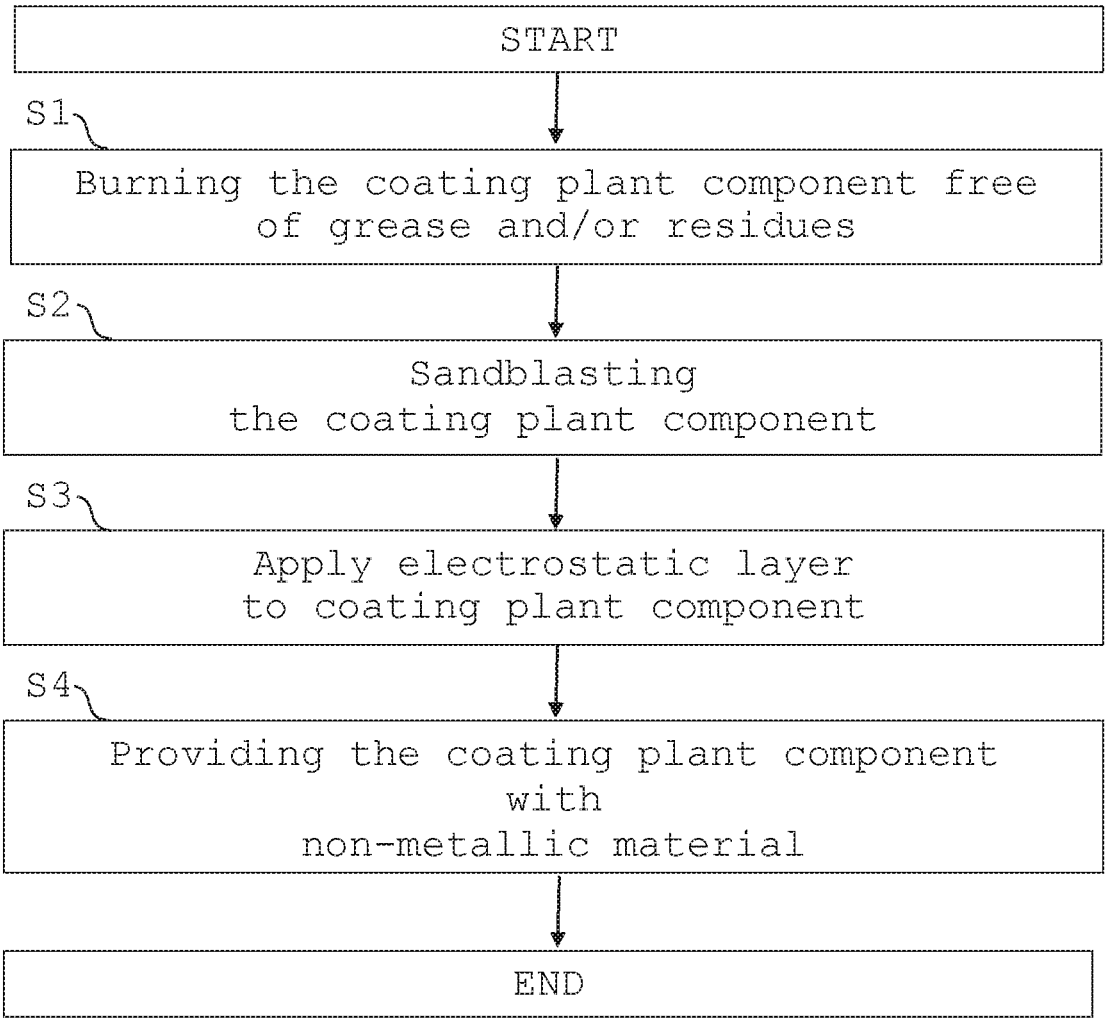

The features of the present disclosure described herein can be combined with one another and are further disclosed the following detailed description of the present disclosure, with reference to the accompanying figures, in which:

FIG. 1 is a sectional view of a front portion of a rotary atomiser having a directing-air ring according to an implementation of the present disclosure, FIG. 2 is a sectional view of a front portion of a rotary atomiser having a directing-air ring according to an implementation of the present disclosure, FIG. 3 is a sectional view of a front portion of a rotary atomiser having a bell cup according to an implementation of the present disclosure, FIG. 4 is a sectional view of a front portion of a rotary atomiser having a directing-air ring according to an implementation of the present disclosure, FIG. 5 is a sectional view of a front portion of a rotary atomiser having a directing-air ring according to an implementation of the present disclosure, and FIG. 6 is a flow diagram of a method according to an implementation of the present disclosure.

DETAILED DESCRIPTION

It should be understood that, similar components or features of the present disclosure are provided with the same reference numerals. Therefore, the description and disclosure of such components should be understood to apply to all implementations of the present disclosure unless otherwise indicated, in order to avoid repetition.

FIG. 1 is a sectional view of an electrostatic rotary atomiser 10 for lacquering motor vehicle bodies and/or add-on parts therefor. The rotary atomiser 10 comprises a bell cup 1, which rotates during operation, for atomising lacquer and for delivering a spray jet of lacquer. The rotary atomiser 10 further comprises a directing-air ring 2, which does not rotate during operation, for delivering a directing-air stream from directing-air outlet openings 7 for shaping the spray jet of lacquer delivered by the bell cup 1. The bell cup 1 is arranged in front of the directing-air ring 2.

The bell cup 1 comprises a metallic base body 1.1 and can be driven by an atomiser shaft 6 in order to rotate during operation. The directing-air ring 2 likewise comprises a metallic base body 2.1. Between the bell cup 1 and the directing-air ring 2 there is a relatively small gap or air space 4.

If the directing-air ring 2 becomes detached or loosens during operation, for example because it has not been mounted correctly and/or because of the pressure for the directing-air that is present during operation, unintentional contact with the bell cup 1 rotating during operation can occur.

In order to prevent sparks and/or flying sparks which may be caused by metal-on-metal rotational contact, the metallic base body 2.1 of the directing-air ring 2 is provided with an at least partial insert or coating of a non-metallic material 3. According to the present disclosure, should the directing-air ring 2 become detached or loosen during operation, the non-metallic material 3 provides a barrier between the metallic base body 2.1 and the bell cup 1, to inhibit metal-on-metal contact. Rather, according to the present disclosure, in such an event, the interface of the bell cup 1 and the directing-air ring 2 is metal-on-non-metal, and thus sparks and/or flying sparks are inhibited.

The non-metallic material 3 is thus designed and arranged to prevent, during operation, metal-on-metal rotational contact between the bell cup 1 and the directing-air ring 2 and consequently sparking if the directing-air ring 2 unintentionally becomes detached or loosens during operation and strikes the rotating bell cup 1. Because the non-metallic material 3 strikes the rotating, metallic base body 1.1 of the bell cup 1 during operation, the non-metallic material 3 is a coating with sufficient thickness to accommodate partial wear or removal of material in such circumstances while maintaining a barrier to the metallic base body 2.1 of the directing-air ring 2. For example, in some implementations, the non-metallic material 3 can have a thickness D of at least about 1.5 mm.

The non-metallic material 3 is arranged in particular on or in the front side of the directing-air ring 2, that is to say the side that faces the bell cup 1 during operation. The non-metallic material 3 is arranged in an annular circumferential manner and is housed in a recess 5 of the directing-air ring 2, which recess is likewise annularly circumferential. Referring to the exemplary implementation of FIG. 1, the non-metallic material 3 is received in the recess 5 as an insert and/or filling and is concave in shape on the side facing the bell cup 1.

The recess 5 serves on the one hand to receive the non-metallic material 3 and on the other hand to receive a rear, backwardly protruding portion 8 of the bell cup 1. The portion 8 projects axially into the recess 5, so that the bell cup 1 and the directing-air ring 2 overlap axially. A compact bell cup/directing-air ring arrangement can thereby be achieved.

The recess 5 is in particular in such a form that it comprises two receiving regions, namely a front receiving region on the front side for receiving the portion 8 and a rear receiving region on the rear side for receiving the non-metallic material 3, the rear receiving region axially extending over the thickness D of the insert of non-metallic material 3.

The directing-air outlet openings 7 of the directing-air ring 2 for delivering the directing-air stream are arranged radially outside the non-metallic material 3.

The non-metallic material 3 is, in some implementations, a suitable plastics material, for example a thermoplastic plastics material, an organic polymer, polyoxymethylene (POM), polyether ether ketone (PEEK), polyamide (PA), polycarbonate (PC), polybutylene terephthalate (PBT), polymethylpentene (PMP), polytetrafluoroethylene (PTFE) and/or ethylene-chlorotrifluoroethylene copolymer (Halar®/ECTFE).

The non-metallic material 3 may be electrically conductive.

The non-metallic material 3, as an alternative or in addition to being arranged on the directing-air ring 2, may also be arranged at least partially on the bell cup 1, so that not only metal-on-non-metal contact but also non-metal-on-non-metal contact can occur within the scope of the present disclosure if the directing-air ring 2 with a coating of non-metallic material unintentionally becomes detached or loosens during operation and comes into contact with the rotating bell cup 1.

The base body 1.1 of the bell cup and the base body 2.1 of the directing-air ring 2 are, however, made of a metal, for example of titanium or stainless steel, for reasons of stability or strength.

FIG. 2 shows a front portion of a rotary atomiser 10 having a bell cup 1 and a directing-air ring 2, shown schematically, according to an implementation of the present disclosure.

In this exemplary implementation of the present disclosure, of the directing-air ring 2 of FIG. 2 is that the non-metallic material 3 is not a relatively thick non-metallic insert as in FIG. 1 but is in the form of a relatively thin non-metallic coating.

The non-metallic material 3 is received in an annular recess 5, which additionally serves to receive the rear, backwardly protruding portion 8 of the bell cup 1.

The recess 5 in FIG. 2 accordingly comprises only one receiving region, which receives together both the non-metallic material 3 and the rear, backwardly protruding portion 8 of the bell cup 1.

The non-metallic material 3 is concave in shape on the side facing the bell cup 1, because the recess 5 is concave in shape.

FIG. 3 shows a front portion of a rotary atomiser 10 having a bell cup 1 according to an implementation of the present disclosure.

A particular feature of the exemplary implementation shown in FIG. 3 is that the non-metallic material 3 is formed not on the directing-air ring 2 but on the bell cup 1.

The non-metallic material 3 is in the form of a non-metallic coating on the rear, backwardly protruding portion 8 of the bell cup 1. The non-metallic material 3 and the portion 8 are arranged in an annular circumferential manner. The portion 8, as already mentioned, serves to be received in the recess 5 on the front side of the directing-air ring 2.

The non-metallic material 3 is convex in shape on the side facing the directing-air ring 2, because the portion 8 is convex in shape.

In an implementation which is not shown, the non-metallic material could also be arranged in a recess in the rear, backwardly protruding portion of the bell cup.

In an implementation which is likewise not shown, the non-metallic material, instead of being in the form of a coating, can be fitted to the rear, backwardly protruding portion of the bell cup as a put-on part in the form of a cap or crown.

FIG. 4 shows a front portion of a rotary atomiser 10 having a directing-air ring 2 according to another exemplary implementation of the present disclosure.

The implementation shown in FIG. 4 is similar to the implementation shown in FIG. 1, but the recess 5 for receiving the non-metallic material 3 and the rear, backwardly protruding portion 8 of the bell cup 1 is larger. This results in a greater axial overlap between the bell cup 1 and the directing-air ring 2 and/or in a more compact bell cup/directing-air ring arrangement. The non-metallic material 3 is shown only schematically. Again, a rear portion of the recess 5 serves to receive the non-metallic material 3.

FIG. 5 shows a front portion of a rotary atomiser 10 having a directing-air ring 2 according to an implementation of the present disclosure.

In the implementation shown in FIG. 5, the non-metallic material 3 is arranged in the form of a coating in the recess 5 of the metallic base body 2.1 of the directing-air ring 2.

The non-metallic material 3 extends in a conically widening manner on the side facing the bell cup 1, because the recess 5 widens conically on the side facing the bell cup 1.

In addition or alternatively, the non-metallic material 3 shown in FIG. 5 can also be formed on the opposite face of the bell cup 1. The non-metallic material 3 then extends in a conically tapering manner on the side facing the directing-air ring 2, because the metallic base body 1.1 tapers conically on the side facing the directing-air ring 2.

FIG. 6 shows a flow diagram of a method for providing a coating plant component 1 with a non-metallic material 3 according to an implementation of the present disclosure.

The coating plant component 1 can in particular be a bell cup 1 or a directing-air ring 2 as described hereinbefore.

In a step S1, the coating plant component 1 is subjected to a burning process in order to render it free of grease and/or residues.

In a step S2, the coating plant component 1 is sandblasted in order to improve the adhesion of the carrier material (e.g. titanium/stainless steel).

In an optional step S3, an electrostatic layer is applied to the coating plant component 1.

In a step S4, the metallic base body 1.1; 2.1 of the coating plant component 1 is provided with a non-metallic material 3. The non-metallic material 3 can be applied, for example, by thermal spraying, powder coating or polymer coating or can be attached as a put-on part or insert to or in the metallic base body 1.1; 2.1.

The present disclosure is not limited to the exemplary implementations described above. Rather, a plurality of variants and modifications is possible, which likewise make use of the principles of the present disclosure.

The invention claimed is:

1. A component for a rotary atomiser, the component comprising:

a bell cup and a directing-air ring operably configured about an axis of the rotary atomizer, one of the bell cup or the directing air ring including a metallic base body having a circumferential surface; and a non-metallic material at least partially covering the circumferential surface, wherein the circumferential surface is configured about the axis of the rotary atomizer, the circumferential surface being configured to face the other of the bell cup and the directing-air ring, the circumferential surface being configured with a shape complementary to the other of the bell cup and the directing-aft ring, wherein the non-metallic material is configured to be a barrier between the metallic base body and the other of the bell cup and the directing-aft ring, wherein the bell cup includes a rear-backwardly protruding portion, wherein the directing-aft ring is provided with a recess configured to receive the rear backwardly protruding portion of a bell cup, wherein the recess includes a continuous arcuate surface that extends from radially outward of the rear-backwardly protruding portion, behind the rear-backwardly protruding portion, to radially inward of the rear-backwardly protruding portion, the recess including a rear apex behind the rear-backwardly protruding portion, wherein the directing aft ring defines a groove at the rear apex, and the non-metallic material is in the groove, and wherein the directing aft ring and the non-metallic material together provide the continuous arcuate surface of the recess.

2. The component according to claim 1, wherein the non-metallic material is arranged in an annular circumferential shape on the circumferential surface.

3. The component according to claim 2, wherein the non-metallic material is one of a coating, an insert and a cover.

4. The component according to claim 1, further comprising at least one intermediate layer between the metallic base body and the non-metallic material.

5. The component according to claim 4, wherein the at least one intermediate layer is an electrostatic layer.

6. The component according to claim 1, wherein the metallic base body includes a sandblasted portion configured to improve the adhesion of the non-metallic material to the metallic base body.

7. The component according to claim 1, wherein the non-metallic material is a plastics material.

8. The component according to claim 7, wherein the non-metallic material is selected from the group comprising:

thermoplastic plastics material,
organic polymer,
polyoxymethylene (POM),
polyether ether ketone (PEEK),
polyamide (PA),
polycarbonate (PC),
polybutylene terephthalate (PBT),
polymethylpentene (PMP),
polytetrafluoroethylene (PTFE), and
ethylene-chlorotrifluoroethylene copolymer (ECTFE).

9. The component according to claim 1, wherein the non-metallic material is electrically conductive.

10. The component according to claim 1, wherein the non-metallic material has a width of less than 3 mm.

11. The component according to claim 1, wherein the thickness of the non-metallic material is greater than 1.4 mm.

12. The component according to claim 1, wherein the recess is arranged in an annular circumferential manner in the front side of the directing-air ring.

13. The component according to claim 1, wherein directing-air outlet openings of the directing-air ring are arranged radially outside the non-metallic material.

* * * * *